United States Patent [19]

Mohn

[11] Patent Number: 4,541,782

[45] **Date of Patent: * Sep. 17, 1985**

[54] PUMP SYSTEM

[75] Inventor: Frank Mohn, London, England

[73] Assignee: Framo Developments (UK) Limited, London

[ * ] Notice: The portion of the term of this patent subsequent to Feb. 19, 2002 has been disclaimed.

[21] Appl. No.: 468,087

[22] Filed: Feb. 18, 1983

[30] Foreign Application Priority Data

Feb. 19, 1982 [GB] United Kingdom ..... 8204942

[51] Int. Cl.[4] ..... F04B 35/04; H02K 5/12

[52] U.S. Cl. ..... 417/244; 417/363; 417/367; 417/422; 417/424; 310/64; 310/87; 310/112

[58] Field of Search ..... 417/244, 422, 424, 366, 417/372, 367, 371, 363; 310/87, 58, 64, 112, 71, 65, 59

[56] References Cited

U.S. PATENT DOCUMENTS

| | | | |
|---|---|---|---|
| 1,428,238 | 9/1922 | Keating | 417/422 |
| 1,872,111 | 8/1932 | Bricken | 417/422 |
| 2,043,283 | 6/1936 | Conant | 310/87 |
| 2,285,436 | 6/1942 | Hoover | 310/87 |
| 2,325,930 | 8/1943 | Arigdor | 417/422 |
| 2,843,052 | 7/1958 | Andrus | 417/363 |
| 2,969,742 | 1/1961 | Arutunoff | 417/424 |
| 3,285,185 | 11/1966 | Feltus | 417/424 |
| 3,411,454 | 11/1968 | Arutunoff | 417/424 |
| 3,890,065 | 6/1975 | Eller et al. | 417/360 |
| 4,126,406 | 11/1978 | Traylor et al. | 310/87 |
| 4,152,097 | 5/1979 | Woodard | 417/360 |
| 4,303,833 | 12/1981 | Eckel et al. | 417/244 |
| 4,413,958 | 11/1983 | Webb | 417/424 |

FOREIGN PATENT DOCUMENTS

| | | |
|---|---|---|
| 1073312 | 11/1964 | Fed. Rep. of Germany . |
| 1371132 | 10/1974 | United Kingdom . |

*Primary Examiner*—Cornellus J. Husar
*Assistant Examiner*—Peter M. Cuomo
*Attorney, Agent, or Firm*—Young & Thompson

[57] ABSTRACT

A submersible pump system comprises a lowermost electrically driven pump unit (4,55) providing an inlet to the system for liquid to be pumped and one or more like pumps (5,55) positioned above it and connected in series. Electric power is supplied to the units by way of conductors within a central pipe (14) concentric with an outer cofferdam pipe (12), dielectric oil being circulated through the conductor pipe and between it and the cofferdam pipe and thus through the pump unit motors which have hollow drive shafts (21) around the conductor pipe. The pump stack may be located within a well casing (52), by sealing rings (62) expanded by the dielectric oil pressure, or surrounded by an outer load-bearing pipe (10). The liquid pumped flows externally of the pump stack and the system can be constructed in separate lengths which can be readily assembled on installation.

17 Claims, 5 Drawing Figures

PUMP SYSTEM

BACKGROUND OF THE INVENTION

The invention relates to pump systems.

Submersible pump systems are used for pumping liquids from oils wells or hot water wells and conventionally comprise a pump unit, comprising a motor driving an impeller or an impeller set, located at the lower end of the system. The pump unit has to be accommodated within the limited dimensions of a borehole and this makes it difficult to provide a pump system which is reliable and efficient.

SUMMARY OF THE INVENTION

The invention accordingly provides a submersible pump system comprising a plurality of pump units connected in series for moving the liquid to be pumped, the pump units being spaced apart between a liquid inlet and a liquid outlet of the system.

One pump unit of a pump system embodying the invention is conveniently located at the lower end of the system, the inlet of this pump unit constituting the liquid inlet of the system. A further pump unit is then located higher up in the system. As many such further series-connected pump units are incorporated in the system as the circumstances require.

The pump units may be hydraulically powered, but preferably each pump unit comprises an impeller or an impeller set driven by an electric motor. Power can then be supplied to the motors by way of conductors located centrally, the motor shafts being hollow so as to surround the conductors.

The system can conveniently comprise a pipe stack having an outer load-bearing pipe with the pump stack comprising the spaced pump units and the power supplies to them secured within it. The space between the pump stack and the outer pump provides a discharge conduit for the pumped liquid. The outer wall of the pipe stack can be constructed so as to carry the weight of the pipe stack, and the conductor and cofferdam pipes allowed to expand and contract relative thereto in response to temperature changes.

Instead, the system can be designed to be received within an existing well casing. The system then comprises a self-supporting pump stack with means whereby the stack can be suitably located with respect to the casing after the stack has been lowered into it. Preferably each pump unit is sealed to the casing by means of an expansible seal device, which is made effective after the pump stack is in place. The pumped liquid is made to flow between the pump stack and the well casing.

The pipe stack is preferably constructed in sections in accordance with the disclosure of U.S. patent application Ser. No. 366,695 which is incorporated herein by reference and the pump stack can be constructed likewise. The sections can be of no greater length than can be conveniently handled and a desired length is built up by connection of such sections together. The system of the present invention can incorporate other features of the disclosure of U.S. patent application Ser. No. 366,695, as will appear.

The conductor tube can thus be filled with a dielectric liquid to minimise insulation requirements for the conductors, and the dielectric liquid can be circulated during operation of the system, the supply path being through the central conductor tube and the return path being an annular duct between the conductor tube and a cofferdam pipe surround it. The dielectric liquid is preferably an oil having lubricating properties and it can then be made to flow through the motor chambers of the pump units.

Thus the oil can be fed downwardly through the central conductor tube to the lowermost pump unit then circulates upwardly through the motor chamber of this unit to effect cooling of the motor and lubrication and lubricating of its bearings, as well as insulation of the motor windings and the connections thereto from the conductors extending along the conductor tube. The oil continues upwardly from the lowermost pump unit motor chamber between the central conductor tube and the cofferdam pipe to the motor chamber of the next pump unit, and thereon upwardly through the or each further pump unit motor chamber until, at ground level, it is filtered, cooled and recirculated and pressure controlled by a suitable pump system.

The circulated dielectric liquid can also be employed to drive a gas separator device in the lowermost pump unit. When the invention is embodied as a pump stack received within an existing well casing, the dielectric liquid can be used as a pressure medium to expand the sealing means by which the pump stack is held within the casing.

The performance of the pump units can be monitored in respect of temperature, vibration level etc., signals being conveyed to ground level to operate a control and/or alarm system.

BRIEF DESCRIPTION OF THE DRAWINGS

The invention will be more readily understood from the following description and from the accompanying drawings, in which.

DETAILED DESCRIPTION OF PREFERRED EMBODIMENTS

Figure 1:
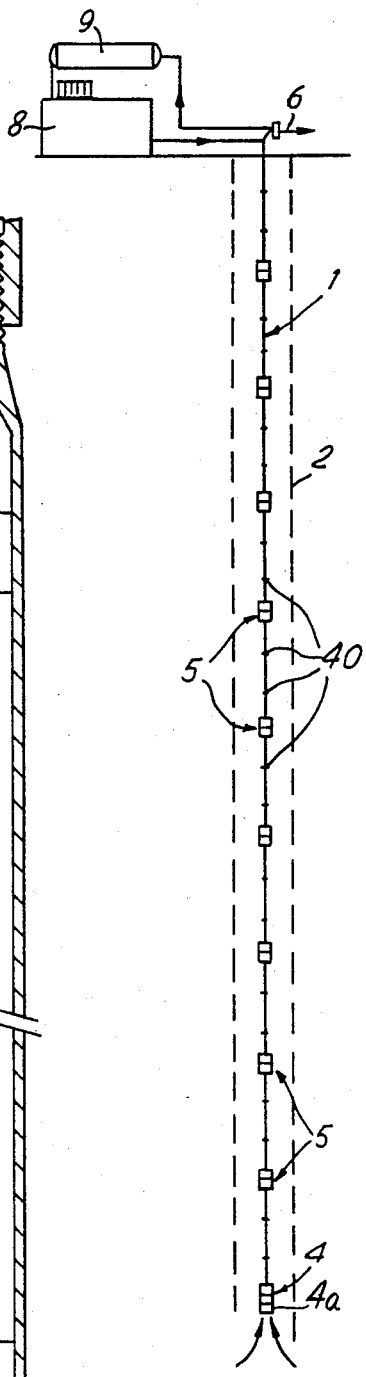
FIG. 1 is a simplified schematic side view of a first electric submersible pump system embodying the invention.

The pump system illustrated in FIG. 1 comprises a pipe stack 1 suspended by a suitable support means at ground level so as to extend downwardly into a borehole 2.

At the lower end of the pipe stack, an electrically driven pump unit 4 withdraws liquid from the borehole and moves it upwardly along the pipe stack. At any suitable position, for example, between 100–500 meters above the pump unit 4, an additional like pump unit 5 provides additional upward thrust for the liquid, and a series of further such additional pump units 5 are spaced along the pipestack 1 at regular intervals. At the upper end of the pipe stack the extracted liquid is conveyed outwardly of the submersible pump system at 6.

Figure 2A:
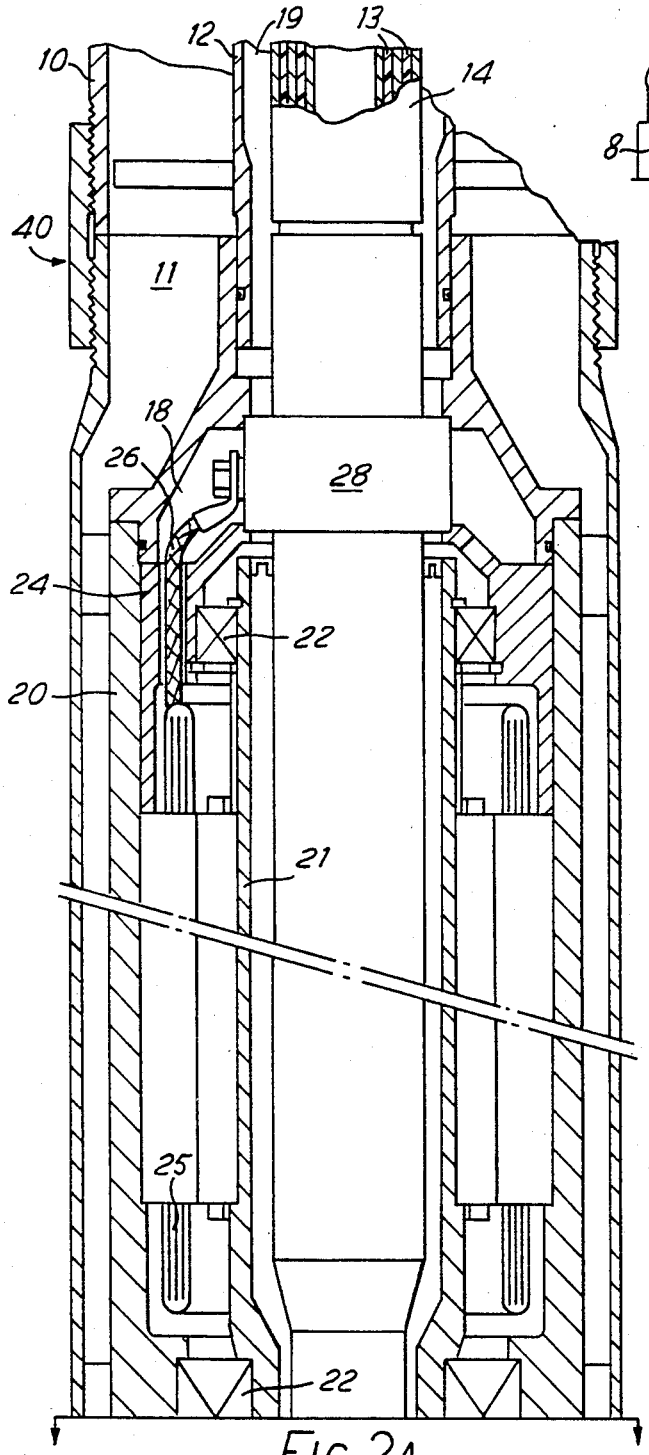
FIGS. 2A and 2B together are a sectional side view of a pump unit included in the system of FIG. 1.

As better shown in FIG. 2A, the portions of the pipe stack 1 between the pump units 4,5 comprise an outer load bearing pipe 10 which defines the outer periphery of a discharge conduit 11 of annular cross-section, the inner periphery of which is defined by a cofferdam protection pipe 12.

Concentrically within the cofferdam pipe 12, there is received a conductor pipe 14 comprising three concentric tubular conductors, for example, of copper, separated from each other by sleeves 13 of insulating material, for example of plastics dielectric material. By these conductors, electric power, at a voltage of the order of 1000 volts, is conveyed to the electric motors of the pump units 4,5. The conductor pipe 14 extends the entire length of the pipe stack 1, down to the lower end of the pump unit 4, and defines between it and the cofferdam pipe 12 a duct 19. At ground level, a recirculating pump 8 supplies dielectric oil through a filter to the conductor pipe 14, preferably at a pressure greater than that of the pumped liquid in the conduit 11, in which it flows to the lower end of the pipestack 1. Here, it reverses direction and travels upwardly through the duct 19 to a cooler 9.

Figure 2B:
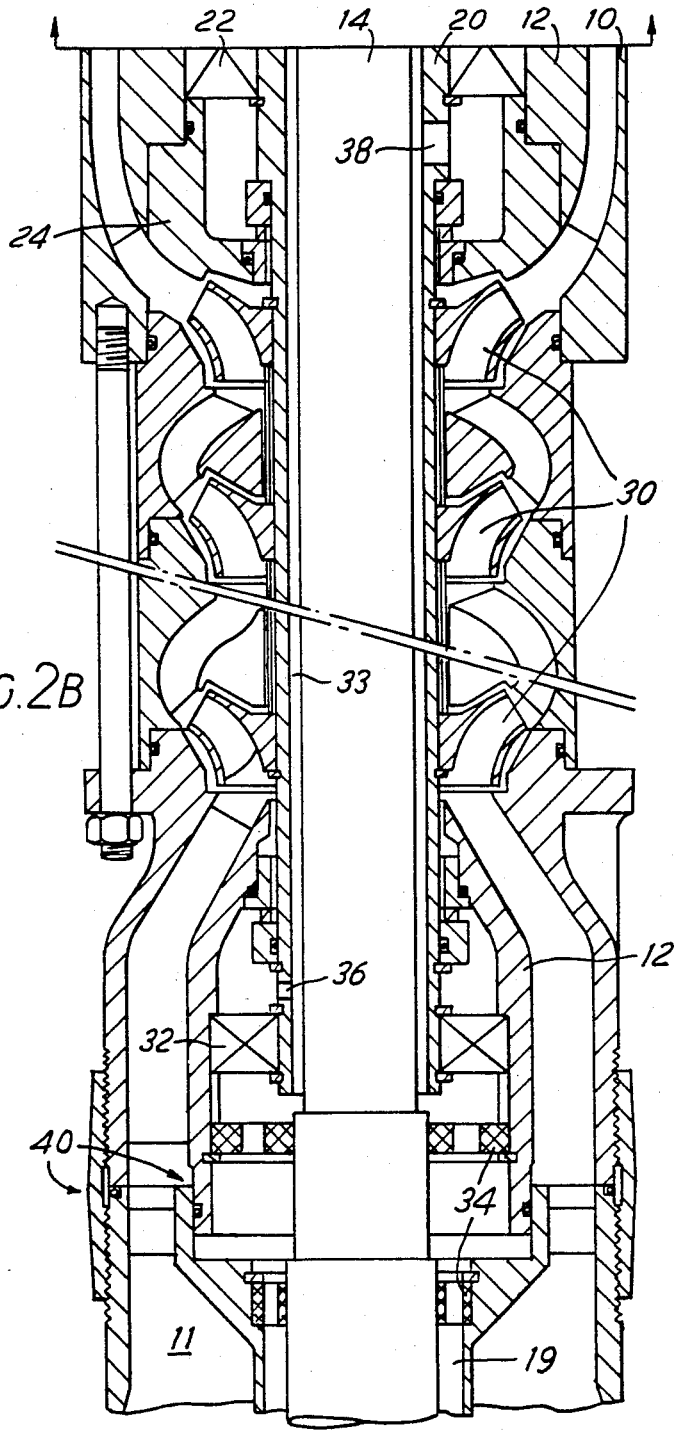

FIGS. 2A and 2B show details of one of the pump units 5. The unit comprises a motor chamber 18 formed by an outwardly extended portion 20 of the cofferdam pipe 12 which enlarges the duct 19 between it and the conductor pipe 14. The motor comprises a hollow shaft 21 surrounding the conductor pipe 14 and journalled by upper and lower bearings 22 carried respectively by upper and lower support fittings 24 within the cofferdam pipe portion 20. Motor windings 25 are connected to the conductors within the pipe 14 by cables 26 extending to terminals on a terminal box 28 by which the conductors are insulatingly sealed through the pipe 14. At its lower end, the motor shaft 21 extends through a seal to the lower support fitting 24 into the annular discharge conduit 11 between the cofferdam pipe and the outer pipe 10, and the shaft extends beyond this seal to mount impellers 30 of an impeller set in the conduit. Beyond the impeller set, the shaft 21 extends through a further seal to the cofferdam pipe 14 and is journalled at its lower end by a further bearing 32.

In operation, the dielectric oil flowing upwardly in the duct 19 enters the region containing the bearing 32, and also the annular space 33 between the shaft 21 and the conductor pipe 14, through apertures in spacers 34 between the conductor pipe 14 and the cofferdam pipe 12. The oil flowing through the bearing enters the space 33 through an aperture 36 in the motor shaft. Above the impeller set the space 33 communicates with the motor chamber 18 through a motor shaft aperture 38.

The pump unit 4 at the base of the pipe stack 1 can differ from the pump unit 5 described only in that the interior of the conductor pipe 14 communicates at the lower end of the unit with the duct 19 between the conductor pipe and the cofferdam pipe 12 to enable the downwardly flowing dielectric oil in the supply path provided by the pipe 14 to reverse direction into the return path provided by the duct. Also, the pump unit 4 can incorporate a gas separator inducer or like pump device 41, powered by the circulating dielectric oil, for the liquid being pumped. The motor chambers 18 and the bearings of the pump units 4,5 are thus in series in the duct 19, as are the impellers 30 of the units in the conduit 11.

Figure 3:
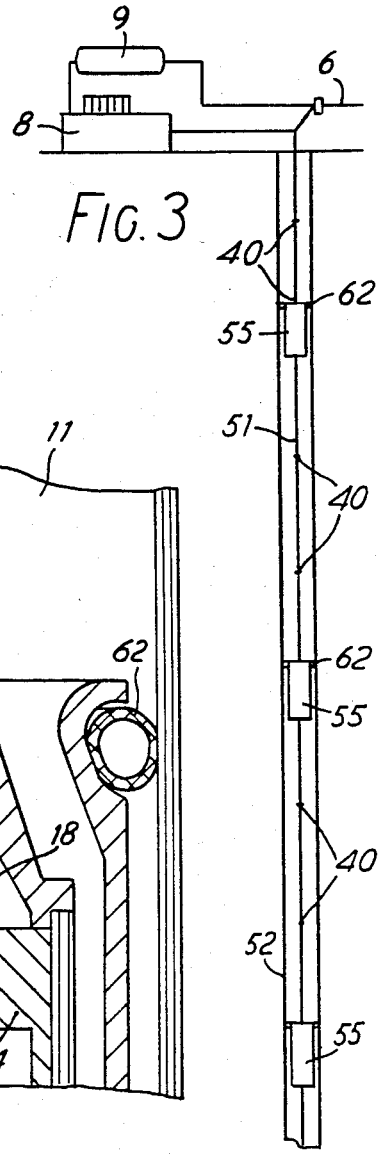
FIG. 3 is a simplified schematic side view of a second electric submersible pump system embodying the invention.
Figure 4:
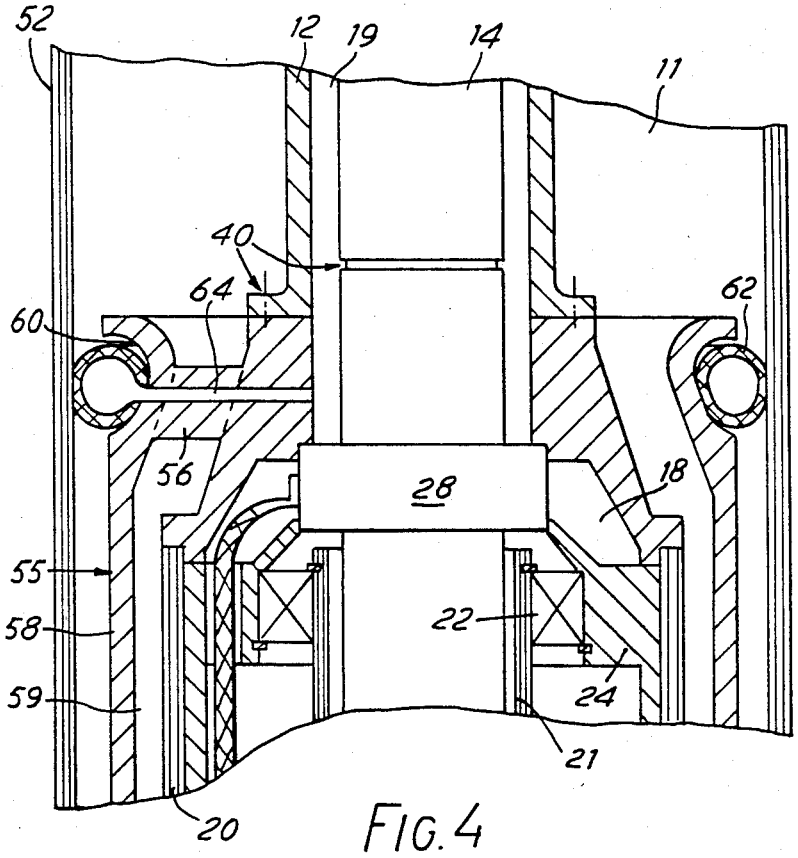
FIG. 4 is a partial sectional side view of a pump unit included in the system of FIG. 3.

In FIGS. 3 and 4 parts similar to those shown in FIGS. 1 and 2 are given the same reference numerals. The pump system illustrated in FIG. 3 comprises a pump stack 51 suspended by any suitable means at ground level so as to extend downwardly within a cylindrical well casing 52. The pump stack 51 has a lowermost pump unit (not shown) and a plurality of like pump units 55 spaced above it. The cofferdam protection pipe 12, with the conductor pipe 14 coaxially received within it extends between the pump units 55 as with the system of FIGS. 1 and 2 but no outer pipe such as the outer pipe 10 confines the upward flow of the liquid being pumped. Instead, the space between the well casing 52 and the pump stack 51 is used as the discharge conduit 11 for the upward flow of the pumped liquid.

At the join with the upper end of the pump unit 55 shown in FIG. 4, the cofferdam protection pipe 12 is provided with an outwardly extending flange by which it is secured to an outwardly extended portion 20 of the pipe containing the motor chamber 18. As with the pump unit 5, the hollow motor shaft 21 surrounds the conductor pipe 14 and is journalled by bearings 22 in upper and lower support fittings of which only the upper fitting 24 is shown.

The cofferdam pipe portion 20 supports externally around it, by means of spaced radial webs 56, a sleeve 58 spaced inwardly from the well casing 52. The sleeve 58 defines around the portion 20 an annular duct 59 in communication at its upper and lower ends with the discharge conduit 11. The upper end of the sleeve 58 is formed with an outwardly facing annular groove 60 and a sealing means in the form of an expansible O-ring 62 received in this groove makes a seal between the sleeve and the well casing 52. As with the system of FIGS. 1 and 2, the duct 19 between the conductor tube 14 and the cofferdam protection pipe 12 provides a return path for dielectric oil and pressure within the ring 62 is maintained by the pressure of this oil. For this purpose, the interior of the ring 62 communicates with the duct 19 by way of a radially extending passageway 64 extending through one of the webs 56. As in the pump units 5, the motor shaft 21 extends downwardly and carries an impeller or impeller system operative to pump liquid in the well casing 52 through the discharge conduit 11 and the annular duct 59 to the system outlet at 6 through any pump unit or units above it in the pump stack.

It will be understood that during installation, the pump stack 51 is lowered down into the well casing 52 without dielectric oil pressure within the duct 19, so the sealing rings 60 are not expanded against the well casing to hinder this movement. When the pump stack 51 has reached the desired position, the dielectric oil is subjected to a controlled pressure so that the rings 62 effect seals between the pump units and the well casing and operation of the system can begin.

Other features, and the operation, of the system of FIGS. 3 and 4 will be understood to be essentially similar to those of the system of FIGS. 1 and 2.

The locating means constituted by the sealing rings 62 can be located otherwise than at the upper end of the pump unit 55, for example, midway along the length of the unit or at the lower end, and more than one such locating means can be provided for each unit.

In both illustrated systems, the dielectric oil flowing in the duct 19 and through the motor chambers 18 serves not only for insulation and for lubrication of the bearings, but also for removal of heat from the motors. To limit heat flow into the dielectric oil from the liquid being pumped, where such heat flow could otherwise occur, thermal insulation can be provided on the cofferdam pipe 12.

As indicated schematically at 40 in FIGS. 1 and 3, and also in FIGS. 2A and 2B, the pipe stack 1 and likewise the pump stack 51 are built up from readily connectable separate sections. The tubular conductors of the conductor pipe 14 have their ends relatively staggered at each end of a length of the pipe or of a pump unit, so that each conductor is slidably receivable within a respective conductor of the tubular conductors of the adjoining section, the ends of which are relatively staggered in the contrary sense. Alternatively, conductors within the conductor pipe 14 may be coupled together at the joints by plug and socket type connectors.

Although the pump units 4,5 of the pump system of FIGS. 1 and 2, and also the units 55 of the system of FIGS. 3 and 4, have been described as being alike, this is not essential. Moreover, pumps operating at different rotational speeds can be employed in the pipe stack where desired.

It is evident that those skilled in the art may make numerous modifications of the specific embodiment described above without departing from the present inventive concepts. It is accordingly intended that the invention shall be construed as embracing each and every novel feature and novel combination of features present in or possessed by the apparatus herein described and that the foregoing disclosure shall be read as illustrative and not as limiting except to the extent set forth in the claims appended hereto.

I claim:

1. A submersible pump system comprising a pump stack including a plurality of pump units, spaced vertically apart, each pump unit having an electric motor, impeller means driven by said electric motor, and an inlet and an outlet for liquid being pumped, the outlet of a lower pump unit communicating with the inlet of a next adjacent upper pump unit whereby said pump units operate in series, pipe means extending between said pump units, tubular electrical conductor means having an internal surface and an external surface, said tubular electrical conductor means being located within said pipe means and being connected to the electric motors of said pump units for supplying power to said motors, means including said internal surface and said external surface of said tubular electrical conductor means defining supply and return paths for dielectric liquid providing insulation for said electrical conductor means, and means for circulating said dielectric liquid along said supply and return paths.

2. The pump system of claim 1 wherein said pump units comprise a lowermost pump unit and at least one upper pump unit vertically spaced above said lowermost pump unit, wherein the electric motor of said at least one upper pump unit is located between said pipe means and said conductor means and includes a hollow drive shaft around said conductor means, and wherein said pipe means is constituted by a portion of said hollow drive shaft extending from said electric motor and having said impeller means connected thereto and by a pipe extending upwardly and downwardly from said hollow drive shaft portion.

3. The pump system of claim 2 wherein said dielectric liquid is a lubricant, and wherein one of said supply and return paths is between said pipe means and said electrical conductor means, whereby said electric motor is lubricated by said dielectric liquid.

4. The pump system of claim 2 wherein said tubular electrical conductor means comprises a plurality of concentric tubular conductors having solid insulation material therebetween, and wherein one of said supply and return paths is constituted by the interior of the inner tubular conductor and the other of said supply and return paths is defined between the outer tubular conductor and the said pipe means.

5. The pump system of claim 1 wherein the dielectric is a lubricant and wherein the electric motors of said pump units located in one of the supply and return paths, whereby said dielectric fluid is circulated through said electric motors.

6. The pump system of claim 1 further comprising a load-bearing outer pipe around the pump stack, and wherein liquid pumped by the pump units flows in the space between the load-bearing outer pipe and the pump stack.

7. The pump system of claim 1 suspended within a well casing, wherein there is a space between said pump stack and said well casing, and the liquid pumped by the pump units flows in said space.

8. The pump system of claim 7 further comprising locating means expandable between said well casing and said pump stack to locate said pump stack within said well casing.

9. The pump system of claim 8 wherein said locating means is expandable by pressure of said dielectric liquid.

10. The pump system of claim 1 further comprising in the lowermost of said pump units gas separator means driven by said dielectric liquid.

11. A pump system comprising:

a pipe stack received within a well casing;

a pump unit at the lower end of said pipe stack, said pump unit having impeller means, an electric motor driving said impeller means, inlet means and outlet means for fluid being pumped by said impeller means, and sealing means responsive to fluid pressure to effect a seal between said pump unit and said well casing at a position above said inlet means and below said outlet means;

conductor means extending along said pipe stack for supplying power to said electric motor;

a pipe surrounding said conductor means;

means defining a fluid circuit having a supply path and a fluid return path along said pipe stack to said pump unit, means for circulating dielectric fluid on said circuit along said supply path to said pump unit and therefrom along said return path, said conductor means being tubular and having one of said supply and return paths along its outer surface and the other of said supply and return paths along its inner surface, whereby said dielectric fluid provides insulation for said conductor means; and means communicating said sealing means with said fluid circuit whereby said seal is effected in response to fluid pressure in said circuit.

12. The pump system of claim 11 wherein said circulating fluid is a lubricant and said pump unit motor is included in said fluid circuit.

13. The pump system of claim 11 further comprising at least one upper pump unit spaced along said pipe stack above said first-mentioned pump unit, said at least one upper pump unit having means responsive to fluid pressure in said fluid circuit to effect engagement between said upper pump unit and said well casing.

14. The pump system of claim 13 wherein said at least one upper pump unit comprises a motor, impeller means driven by said motor, a pipe having said motor and said fluid supply and return paths therewithin, and a sleeve around and spaced outwardly from said pipe for the passage of liquid pumped by said pump units between said pipe and said sleeve, and wherein said means responsive to fluid pressure comprises an expansible ring around said sleeve.

15. The pump system of claim 11 wherein said pipe stack further comprises at least one support means responsive to fluid pressure in said fluid circuit to effect supporting engagement between said pipe stack and said well casing at a location upwardly of said pump unit.

16. The pump system of claim 15 wherein said at least one support means is adapted to effect sealing engagement between said pipe stack and said well casing.

17. The pump system of claim 11 further comprising gas separator means in said pump unit, said gas separator means being driven by said fluid in said fluid circuit.

* * * * *